United States Patent [19]

Asano et al.

[11] 4,411,538

[45] Oct. 25, 1983

[54] PRINT-HEAD OF A DOT-PRINTER

[75] Inventors: Kiyomitsu Asano, Musashino; Toshikatsu Kondo; Shigeru Mizuno, both of Nagoya, all of Japan

[73] Assignees: Brother Kogyo Kabushiki Kaisha, Aichi; Nippon Telecommunication Eng. Co., Tokyo, both of Japan

[21] Appl. No.: 290,300

[22] Filed: Aug. 5, 1981

[30] Foreign Application Priority Data

Aug. 11, 1980 [JP] Japan ..... 55-113601[U]

[51] Int. Cl.[3] ..... B41J 3/12

[52] U.S. Cl. ..... 400/124; 101/93.05

[58] Field of Search ..... 400/124; 101/93.05

[56] References Cited

U.S. PATENT DOCUMENTS 4,136,978 1/1979 Bellinger, Jr. et al. ..... 400/124

4,204,778 5/1980 Miyazawa et al. ..... 400/124

4,218,148 8/1980 Matschke ..... 400/124

4,348,120 9/1982 Isobe et al. ..... 400/124

*Primary Examiner*—Paul T. Sewell

*Attorney, Agent, or Firm*—Browdy and Neimark

[57] ABSTRACT

A print head adapted to be used for a dot-printer. A novel support device is disposed in the print head for pivotally supporting one end of each of a plurality of armatures on a support member. The support device in this invention comprises; (a) a leaf spring disposed longitudinally of the armature, secured at one end thereof to the support member and at the other end thereof to the armature, and provided in a middle portion thereof with a through-bore, and (b) a wire spring extending through the through-bore in the leaf spring at a right angle thereto, and secured at one end thereof to the support member and at the other end thereof to the armature.

10 Claims, 5 Drawing Figures

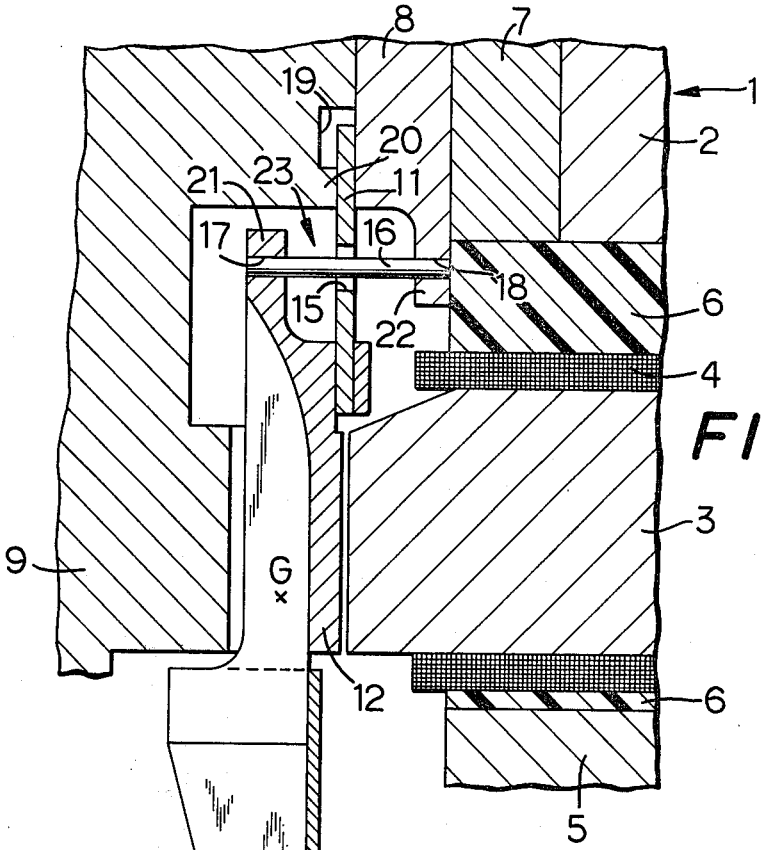
FIG. 3
FIG. 4
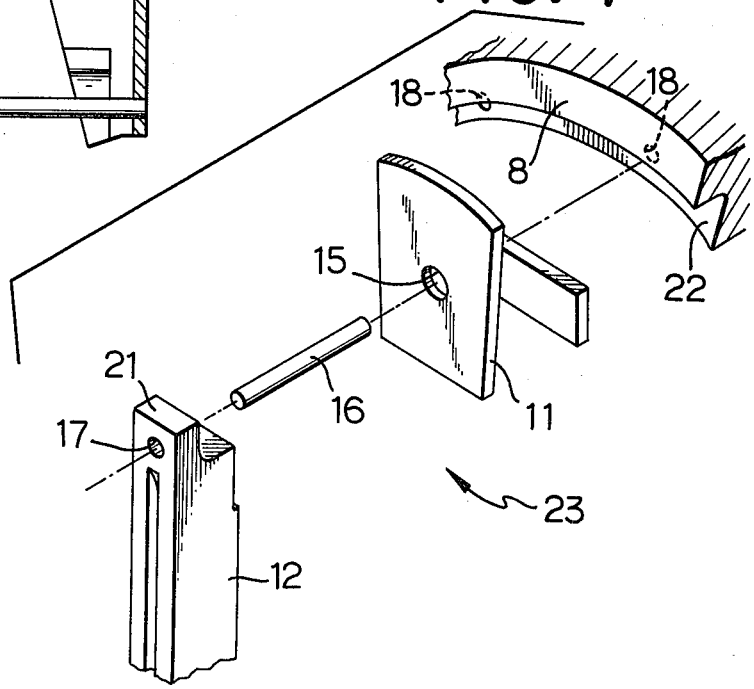

PRINT-HEAD OF A DOT-PRINTER

BACKGROUND OF THE INVENTION

This invention relates to a print head for a serial dot-printer.

For the purpose of enhancing the printing speed of a print head used in a serial dot-printer, U.S. Pat. No. 4,136,978 discloses a print head utilizing its then newly developed armature supporter.

In this armature supporter of the prior art, an armature on which a print wire is fixed is pivotally supported by a pair of leaf springs crossing each other at right angles. The armature is thus retrained from movements other than swinging or oscillation, so as to improve the response speed of the armature.

This art has attempted to obtain superior print quality in serial dot-printers, that is, attempted to improve the print quality of dot-printers up to a level comparable to the quality of ordinary printing obtained by means of types or fonts, to give dot-printers fine graphic printing, capability. Such attempts have usually increased the number of print wires incorporated into one print head.

Employing the armature supporter disclosed by the U.S. Pat. No. 4,136,978 to meet the dual requirements of raising the printing speed and improving print quality necessarily results in a large space needed to support one armature. The greater the number of print wires incorporated in one head, the larger the size of the print head. This causes in turn an increase in the gross weight of the print head, leading to enlargement of the drive mechanism including the motor for laterally moving the print head along the surface of the platen. Increases in the manufacturing cost for such printers inevitably result from the above prior art attempts.

OBJECTS AND SUMMARY OF THE INVENTION

It is a primary object of this invention to provide a compact print head for a dot-printer ensuring high speed printing and superior print quality.

It is another object of this invention to provide a compact print head for a dot-printer capable of incorporating a number of print wires.

It is a further object of this invention to provide a print head for a dot-printer which is simple in assembly and inexpensive to manufacture.

The present invention attains the above-mentioned objects and can be summarized as to its features as follows. This invention provides a novel print head adapted to be incorporated into a serial dot-printer including a support member, a plurality of armatures, support means for pivotally supporting each of the armatures at one end thereof on the support member, a plurality of print wires secured to the other end of each of the armatures perpendicular to the longitudinal direction of the armature, and drive means disposed respectively corresponding to each of the armatures for selectively driving the armatures. The support means in the print head comprises: (a) a leaf spring disposed longitudinally of the armature, secured at one end thereof to the support member and at the other end thereof to the armature, and provided at a middle portion thereof with a through-bore, and (b) a wire spring disposed piercing through the through-bore in the leaf spring at substantially a right angle thereto, and secured at one end thereof to the support member and at the other end thereof to the armature.

BRIEF DESCRIPTION OF THE DRAWING

FIG. 3 is an enlarged sectional view of an essential part of the print head;

FIG. 4 is an exploded perspective view of an essential part of the print head.

DETAILED DESCRIPTION OF THE PREFERRED EMBODIMENTS

With reference to the appended drawings, preferred embodiments of this invention will be described in detail hereunder.

Figure 1:
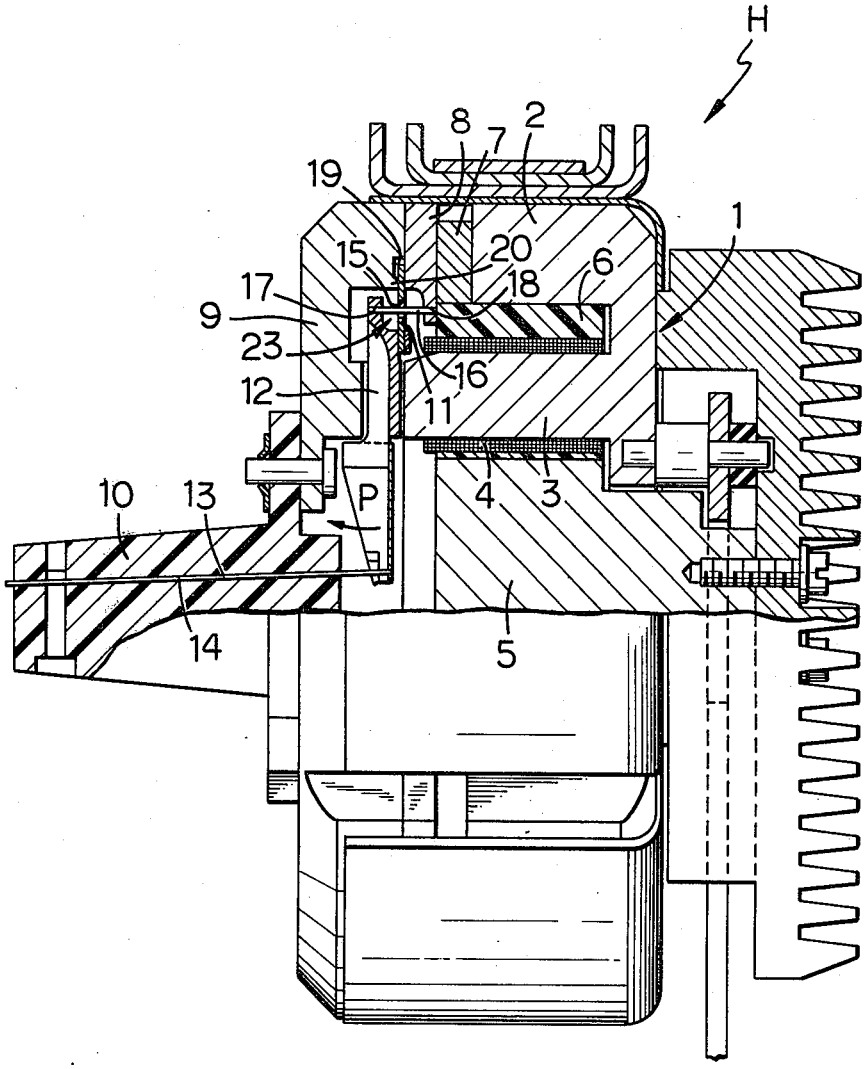
FIG. 1 is a side view, partly broken away, of an embodiment of a print head embodying this invention.
Figure 2:
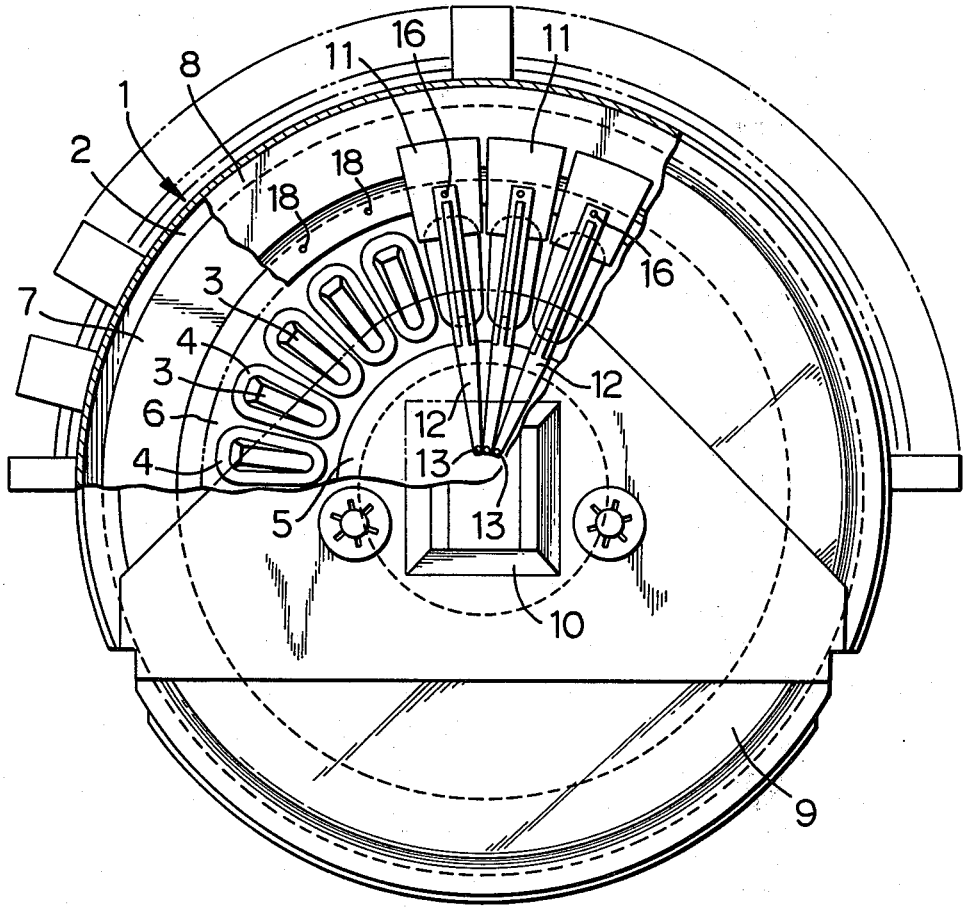
FIG. 2 is an elevational view, partly broken away, of the print head.

On the front side of a magnetic member 1 disposed at the rear portion of a print head according to a first embodiment of this invention generally designated by letter H, an annular yoke portion 2 and a plurality of core portions 3 are formed integrally with member 1 as shown in FIGS. 1 and 2. About each of the core portions 3 a coil 4 is wound. In the central area of the magnetic member 1, there is disposed a heat sink member 5 to radiate heat produced when the coils 4 are energized or current is conducted. Spaces defined by the coils 4, the heat sink member 5, and the yoke portion 2, are filled with synthetic resin 6 of high heat conductivity.

On the front surface of the yoke portion 2 an annular permanent magnet 7 is firmly fixed, and on the front surface thereof an annular or ring shaped armature support member 8 of magnetic material is secured. On the front surface of the armature support member 8 a cover member 9 of magnetic material is secured to form the facade of print head H, and to the central portion of the cover member 9 a guide member 10 is projectingly secured. Normally, a magnetic path which respectively passes through the yoke portion 2, the core portions 3, the cover member 9, and the support member 8 is formed by virtue of the permanent magnet 7. When the coil 4 is energized a magnetic flux counteracting the force of this magnetic path is formed. Thus, a drive device is formed by the combination of the permanent magnet 7, the yoke portion 2, the core portions 3, the coil 4, etc.

On the front surface of the support member 8 a plurality of leaf springs 11 which correspond to each of the core portions, are secured at the base portions thereof by laser beam weld. On the inner end of each leaf spring 11 an armature 12 made of a magnetic material is respectively secured at the foot thereof so as to extend longitudinally of the leaf spring 11, i.e. to extend radially inwardly from the vicinity of the ring shaped support member 8 so that the free ends of the armatures 12 are all located around the center of the support member 8. The armatures 12 are normally attracted onto the end surface of the core portions 3 by the magnetic force of the permanent magnet 7 while resisting the resilient force of the leaf springs 11. When the magnetic path due to the permanent magnet 7 is overcome by the energization of the coil 4, however, the armature 12 is moved, or separated, as shown in FIGS. 1 and 3, in the direction of arrow P, away from the end surface of the core portions 3 due to the resilient force of the leaf springs 11.

To the free end of each of the armatures 12 a print wire 13 is individually secured at a right angle and extends forwardly passing through a guide opening 14 bored in the guide member 10. The free ends of the print wires 13 fixed to the armatures 12 are projected, upon every separation of the armatures 12 from the core portions 3, forward out of the guide member 10 to perform printing operations.

In the middle portion of each leaf spring 11 a perforation 15 is formed through which a wire spring 16 of circular section is inserted, as shown in FIGS. 3 and 4, at a right angle to leaf spring 11. The wire spring 16 is fitted at one end thereof in an aperture 17 formed in a projection 21 of the armature 12, and at the other end thereof in an aperture 18 formed in the projection 22 of the support member 8. Wire spring 16 is firmly welded in apertures 17 and 18 by suitable means such as laser welding on both ends thereof. The projection 21 protrudes radially outwardly from a forwardly offset portion of the armature 12 in the longitudinal direction thereof. On the other hand, the projection 22 protrudes radially inwardly from a rearwardly offset portion of the support member 8, that is, in the opposite direction to the projection 21. The wire spring 16 is connected between the two projections 21, 22. The wire spring 16 and the leaf spring 11 constitute a support device 23 for supporting the armature 12.

At portions of the cover member 9 facing to the leaf springs 11 is formed an annular hollow 19 and a ring shaped abutment which is radially inwardly adjacent the hollow 19. The abutment 20 protrudes from the bottom surface of the hollow 19 and urges the leaf springs 11 onto the support member 8 strongly enough to straighten the leaf springs, i.e., to remedy or rectify any strain or deformation therein incurred being welding. The, end surface of the core portion 3, the surface of the armature 12 facing the core portion 3, the surface of the support member 8 where the armature 12 is secured, and end surface of the abutment 20, are all finely finished so that a rest position of the armature 12 may be exactly established.

When the coil 4 is energized while the armature 12 is at rest and attracted to the end surface of the core portion 3 by the magnetic force of the permanent magnet 7, the armature 12 is swung in the direction of arrow P due to the resilient force of the lead spring 11 as far as the illustrated position in FIG. 3, causing the tip of the print wire 13 to strike the printing surface of the platen. At the moment the tip of the print wire 13 has struck the printing surface, a reactional force is exerted on the armature 12 in a direction opposite arrow P to cause the armature to rotate about an artificial centroid G marked in FIG. 3.

This rotational force acts however on the wire spring 16 in tension, so that movement of the armature 12 due to this rotational force is naturally restructed.

When the coil 4 is deenergized, after completing one printing motion, the armature 12 is again attracted to the end surface of the core portion 3 by the magnetic force of the permanent magnet 7. Due to impact of the attraction, the armature 12 is affected by a counter direction P rotational force which acts to rotate armature 12 about the centroid G. Since this force also acts on the wire spring 16 in a tension, the movement of the armature 12 caused by the rotational force is similarly restricted.

As can be understood from the above, the wire spring 16 is required to have rigidity above a certain lowest limit for the purpose of restricting undesirable or unnecessary movement of the armature 12 under the influence of the tension forces. The wire spring 16 in this embodiment can be effectively rigid, with the smallest width and cross-sectional area, thanks to its circular cross-sectional configuration. This advantageous rigidity of the wire spring 16 due to its configuration allows in turn each of the leaf springs 11, through which the wire spring 16 passes to be reduced in their width, which eventually contributes to reduction in size of the print head itself. In other words, the leaf spring 11 needs to have a width above a certain predetermined value to ensure a required spring force. Assuming that another leaf spring were to replace the wire spring 16, the leaf spring 11 would have to be enlarged in its whole width due to the width of the assumed leaf spring, which consequently enlarges the size of the print head itself.

Thus, in summation of this description of wire spring 16, its primary function is to prevent undesired pivotal movement of the armature 12 about artificial centroid G at the two points in the cycle of operation; when wire spring 12 returns to its straight relaxed position shown in FIG. 3 when the coil 4 is energized from its slightly bent position before energization; and at the end of a printing motion after coil 4 is de-energized. Depending upon which part of armature 12 first strikes the face of core 3, a differing force tending to rotate the armature about artificial centroid G can be created. Wire spring 16 is subjected to a corresponding tension force to resist that tendency. Since wire spring 16 responds on both occasions in tension, it can have a small mass which reduces size and weight of the print head overall, all as set forth above.

Formation of apertures 17, 18 in the armature 12 and the support member 8 for inserting either end of the wire spring 16 so as to be welded therein by laser beam makes the welding operation quite easy. If the welding were to be conducted while the wire spring 16 was being simply abutted on the end surface of the armature 12 and the support member 8, the laser beam would have to be applied to the delicate contact surfaces at either end of the wire spring 16 with the armature 12 and the support member 8, respectively. In the invention, where the wire spring 16 ends are fitted into the apertures 17, 18, the laser beam welding is quite easy, one simply applies the laser beam on the end surfaces of the wire spring 16.

Figure 5:
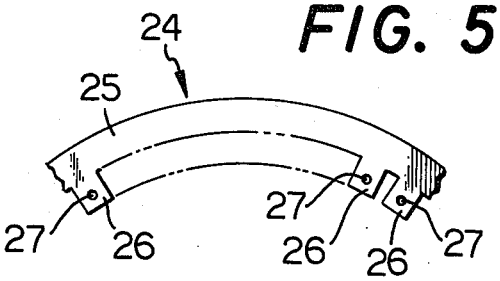
FIG. 5 is a partial elevational view of leaf springs used in another embodiment of a print head in accordance with this invention.

Although the leaf springs 11 are made separately in the above embodiment, respectively, it is also permissible to integrally form a number of leaf springs on one resilient member 24 as illustrated in FIG. 5.

The resilient member 24 consists of a ring shaped fixing portion 25 and tongues or rectangular leaf spring portions 26 radially inwardly extending from the fixing portion 25. The fixing portion 25 is welded at outer portions thereof to the aforementioned support member 8 and is pinched at inner portions thereof between the abutment 20 and the support member 8. Each armature 12 is welded at one end thereof to each free end of the leaf spring portions 26 and each wire spring 16 is passed through a perforation 27 formed in the middle portion of each leaf spring portion 26. All other parts and members are similar to those in the previous embodiment, so further description thereof may be omitted.

While the invention has been described in detail above, it is to be understood that this detailed description is by way of example only, and the protection granted is to be limited only within the spirit of the invention and the scope of the following claims.

What is claimed is:

1. A print head adapted to be incorporated into a serial dot-printer comprising:

a support member;

a plurality of armatures;

a leaf spring disposed along the longitudinal direction of each of said armatures secured at one end thereof to said support member and at the other end thereof to one end of each respective one of said armatures, each said leaf spring being formed in a middle portion thereof with a perforation;

a wire spring extending through each said perforation at substantially a right angle to each said leaf spring and secured at one end thereof to said support member and at the other end thereof to said one end of its corresponding one of said armatures;

a print wire secured to the other end of each of said armatures disposed generally perpendicular to the longitudinal direction of its respective one of said armatures; and drive means selectively driving each of said armatures.

2. A print head as claimed in claim 1, wherein said wire spring is circular in cross section.

3. A print head as claimed in claim 1, wherein both ends of said wire spring are fitted in apertures formed in said support member and said armature respectively, and are welded at said apertures.

4. A print head as claimed in claim 1, wherein said leaf spring is welded at said other end thereof to a rear surface of said armature and at said one end thereof to a front surface of said support member, said wire spring being connected between a first projection protruded radially outwardly from a forwardly offset portion of said armature in the longitudinal direction of said armature and a second projection protruded radially inwardly from a rearwardly offset portion of said support member in said longitudinal direction.

5. A print head as claimed in claim 1, wherein said support member is of substantially ring shape and said armatures extend radially inwardly from the vicinity of said support member so that said print wires secured to the other ends of said armatures are all located around the center of said support member.

6. A print head as claimed in claim 1, wherein said leaf springs are tongues extending radially inwardly as integral parts of a ring shaped portion which is fixed to said support member.

7. A print head adapted to be incorporated into a serial dot-printer including a support member, a plurality of armatures, support means for pivotally supporting each of the armatures at one end thereof on said support member, a print wire secured to the other end of each of said armatures perpendicularly to the longitudinal direction of said each armature, and drive means disposed corresponding to said armatures for selectively driving said armatures, said support means comprising:

a resilient member including a fixing portion secured to said support member and a plurality of leaf spring portions extending radially inwardly from and as integral parts of said fixing portion in a longitudinal direction of each of said armatures and secured at the free ends thereof to said armatures, each of said leaf spring portions being provided in the middle portion thereof with a perforation; and a wire spring extending through said perforation at right angle to said leaf spring portion, and secured at one end thereof to said support member and at the other end thereof to said each armature.

8. A print head adapted to be incorporated into a serial dot-printer including a support member of substantially ring shape, a plurality of armatures disposed such that one respective end thereof is positioned in the vicinity of said support member and the other end thereof is located around the center of said support member, support means for pivotally supporting each of said armatures at one end thereof on said support member, a print wire secured to the other end of each of said armatures perpendicularly to the longitudinal direction of said each armature, and drive means disposed corresponding to each of said armatures for selectively driving said armatures, said support means comprising:

a resilient member including a fixing portion of substantially ring shape secured to said support member and a plurality of leaf spring portions integrally extending radially inwardly from said fixing portion and secured at the free ends thereof to said armatures, respectively, each of said leaf spring portions being provided in a middle portion thereof with a perforation; and a wire spring extending through said perforation at right angle to said leaf spring portion, and being secured at one end thereof to said support member and at the other end thereof to said each armature.

9. A print head adapted to be incorporated into a serial dot-printer comprising:

a support member;

a plurality of armatures;

a leaf spring disposed along the longitudinal direction of each of said armatures secured at one end thereof to said support member and at the other end thereof to one end of each respective one of said armatures; each said leaf spring being formed in a middle portion thereof with a perforation;

a wire spring extending through each said perforation at substantially a right angle to each said leaf spring and secured at one end thereof to said support member and at the other end thereof to said one end of its corresponding one of said armatures;

a print wire secured to the other end of each of said armatures disposed generally perpendicular to the longitudinal direction of its respective one of said armatures;

drive means selectively driving each of said armatures; and said leaf spring and said wire spring comprising support means for each respective one of said armatures in said print head, whereby said wire spring extending through said wire spring perforation permits the leaf spring dimension in planes perpendicular to said wire spring to be made smaller to permit a larger number of said armatures in a given size print head.

10. A print head adapted to be incorporated into a serial dot-printer comprising:

a support member;

a plurality of armatures;

a leaf spring disposed along the longitudinal direction of each of said armatures and secured at one end thereof to said support member and at the other end thereof to one end of each respective one of said armatures, each said leaf spring being formed in a middle portion thereof with a perforation;

a wire spring extending through each said perforation at substantially a right angle to each said leaf spring and secured at one end thereof to said support member and at the other end thereof to said one end of its corresponding one of said armatures;

a print wire secured to the other end of each of said armatures and disposed generally perpendicular to the longitudinal direction of its respective one of said armatures;

drive means selectively driving each of said armatures;

a cover member covering said leaf springs and said wire springs and secured to said support member, said cover member having a hollow facing said one end of said leaf spring, the latter being welded to said support member, said cover member further having an abutment projecting from a bottom surface of said hollow, said abutment urging, against said support member, a portion of said leaf spring between a middle portion thereof and said one end to straighten said one end of said leaf spring which may be possibly deformed during the welding thereof to said support member.

* * * * *